US008499608B2

(12) United States Patent
May

(10) Patent No.: US 8,499,608 B2
(45) Date of Patent: Aug. 6, 2013

(54) BENDING TOOL

(76) Inventor: Vince May, Owensboro, KY (US)

( * ) Notice: Subject to any disclaimer, the term of this patent is extended or adjusted under 35 U.S.C. 154(b) by 125 days.

(21) Appl. No.: 13/199,657

(22) Filed: Sep. 6, 2011

(65) Prior Publication Data

US 2012/0060579 A1 Mar. 15, 2012

Related U.S. Application Data

(60) Provisional application No. 61/403,128, filed on Sep. 10, 2010.

(51) Int. Cl.
*H01R 43/033* (2006.01)

(52) U.S. Cl.
USPC ..... 72/479; 72/458; 140/123

(58) Field of Classification Search
USPC ..... 72/479, 458, 388, 389.1, 457, 459; 81/176.15, 485; 7/117; 140/123
See application file for complete search history.

(56) References Cited

U.S. PATENT DOCUMENTS

| | | | | | |
|---|---|---|---|---|---|
| 956,985 | A | * | 5/1910 | Maher | 72/479 |
| 1,228,611 | A | * | 6/1917 | Shults | 7/117 |
| 2,847,054 | A | * | 8/1958 | Sutchliffe | 72/388 |
| 3,732,721 | A | * | 5/1973 | Cusimano | 72/458 |
| 3,737,560 | A | * | 6/1973 | Takatori et al. | 248/278.1 |
| 5,680,789 | A | * | 10/1997 | Brooke | 72/458 |
| 5,758,537 | A | * | 6/1998 | Throssel | 72/458 |

* cited by examiner

*Primary Examiner* — Teresa M Ekiert
(74) *Attorney, Agent, or Firm* — Gary K. Price

(57) ABSTRACT

A bending tool for bending and shaping general purpose building wire and cable. The bending tool including a main body having a first end opposite a second end. The first and second ends each include a pair of metal dowels fixedly attached with couplings. Each pair of metal dowels are spaced apart and define a spacing sized for releasably receiving a cable wire such as the 500 MCM cable, between the pair of metal dowels. Preferably, each of the pair of metal dowels define an outer knurled surface.

12 Claims, 3 Drawing Sheets

BENDING TOOL

CROSS REFERENCES TO RELATED APPLICATIONS

U.S. Provisional Application for Patent No. 61/403,128, filed Sep. 10, 2010, with title "Bending Tool" which is hereby incorporated by reference. Applicant claim priority pursuant to 35 U.S.C. Par. 119(e)(i).

Statement as to rights to inventions made under federally sponsored research and development: Not Applicable

BACKGROUND OF THE INVENTION

1. Field of the Invention

The present invention relates to manual force applying tools and, in particular, bending tools designed to bend or shape general purpose building wire or cable.

2. Brief Description of Prior Art

General purpose building wiring or cable is widely employed in a number of different building construction applications, including residential, commercial and industrial buildings. As is often the case, the cable or wire used in building construction requires bending or shaping in order for installation through a conduit body or fitting. As known in the art, in application, the conduit has an entry and an exit for the cable to pass. In many conduit designs, in order for the cable to enter the conduit and run though the exit, the cable must have a 90 degree bend. However, the cables or wires, such as the 500 MCM (thousand circular mils) cable, are usually heavy, and very difficult to manually bend or shape. Available tools presently employed for such bending and shaping are cumbersome devices which are difficult to manipulate, particularly in precarious positions in which the workman often find themselves.

As will be seen from the subsequent description, the preferred embodiments of the present invention overcome shortcomings of the prior art.

SUMMARY OF THE INVENTION

Briefly stated, the present invention is directed to a bending tool for bending and shaping general purpose building wire and cable. The bending tool generally includes an elongated main body having a first end opposite a second end. The first and second ends each include a pair of metal dowels fixedly attached with couplings. Each pair of metal dowels are spaced apart and define a spacing sized to releasably receive a cable wire such as the 500 MCM cable, between the pair of metal dowels. Preferably, each of the pair of metal dowels define an outer knurled surface.

DESCRIPTION OF THE PREFERRED EMBODIMENTS

In accordance with the present invention, a bending tool for bending and shaping general purpose building wire and cable is disclosed. More particularly, the described tool relates to an apparatus for manipulating heavy cable, such as the 500 MCM cable, that is very difficult to manually bend or shape. Specifically, it will be noted in the following description that the present bending tool is designed for bending heavy building wire or cable to run through a prior art conduit or fitting. In the broadest context, the bending tool of the present invention consists of components configured with respect to each other so as to attain the desired objective.

Figure 1:
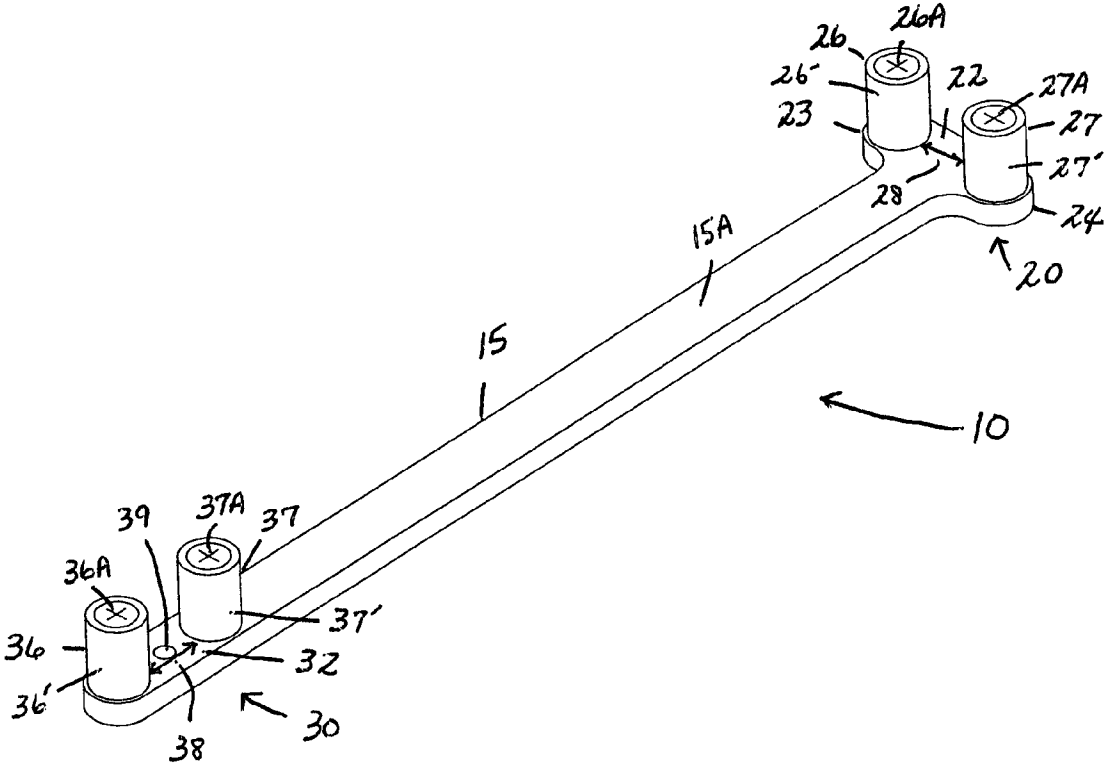
FIG. 1 is a perspective view of the preferred embodiment of the present invention, a bending tool.

Referring to FIG. 1, the bending tool of the present invention designated as numeral 10 generally includes an elongated main body 15 having a first end 20 opposite a second end 30. The main body 15 is constructed of steel or of rigid like material. While the drawings illustrate the main body 15 having a relatively long and narrow configuration, it should be understood that other shapes and designs for the main body can be used to carry out the teachings of the present invention.

In the preferred embodiment, the first end 20 is integral to the main body 15 and is in perpendicular relationship with the length of the main body 15, the main body 15 and first end 20 forming a T-shaped configuration. The first end 20 further includes a surface 22 that defines opposite ends 23, 24 of the first end 20.

The opposite ends 23, 24 each have metal dowels 26, 27 respectively, fixedly attached with couplings 26A, 27A, to the first end 20. As illustrated the metal dowels 26, 27 are spaced apart and define a spacing 28 therebetween. As will be understood, in application, the spacing 28 is sized for releasably receiving a cable wire (not shown) such as the 500 MCM cable, between the metal dowels 26, 27. The metal dowels 26, 27 having a generally cylindrical configuration and further including an outer surface 26' and 27'.

As is known in the art, many of the building cables or wires available include a nylon jacket that is abrasion-resistant having a slippery surface. The inventor has determined it critical, when working with cable having a slick surface, for the outer surfaces 26' and 27' of the dowels to define an outer knurled periphery in order to create a traction between the slick nylon jacket of the cable and the metal dowels 26, 27. Further, should the knurled outer surface 26', 27' begin to wear, the couplings 26A, 27A can be loosened such that the dowels 26, 27 can be rotated on the first end 20.

In the preferred embodiment, the second end 30 is integral to the main body 15 and includes a surface 32 that have metal dowels 36, 37 fixedly attached with couplings 36A, 37A, in parallel with the length of the main body 15. As illustrated the metal dowels 36, 37 are spaced apart and define a spacing 38 therebetween. As will be understood, in application, the spacing 38 is sized for releasably receiving a cable wire (not shown) such as the 500 MCM cable, between the metal dowels 36, 37. The metal dowels 36, 37 having a generally cylindrical configuration and further including an outer surface 36' and 37'.

In the preferred embodiment, like the metal dowels 26, 27, the inventor has determined it critical, when working with cable having a slick surface, for the outer surfaces 36' and 37' of the dowels to define an outer knurled periphery in order to create a traction between the slick nylon jacket of the cable and the metal dowels 36, 37. Further, should the knurled outer surface 36', 37' begin to wear, the couplings 36A, 37A can be loosened such that the dowels 36, 37 can be rotated on the second end 30.

The second end 30 can further include an aperture 39 disposed between the metal dowels 36, 37. The aperture 39 designed for displaying or hanging the tool 10 on a single hanger rod on a display rack.

While the preferred embodiment defines a main body 15 having first and second ends 20, 30 as described. It should be understood that the main body 15 could be constructed with only one end including a pair of spaced apart dowels having the configuration described for the first end 20 or the second end 30. Further, while the pair of spaced apart dowels may be aligned as illustrated and discussed, the dowels may be arranged in various alignments as long as the spacing between the dowels is maintained.

Figure 2:
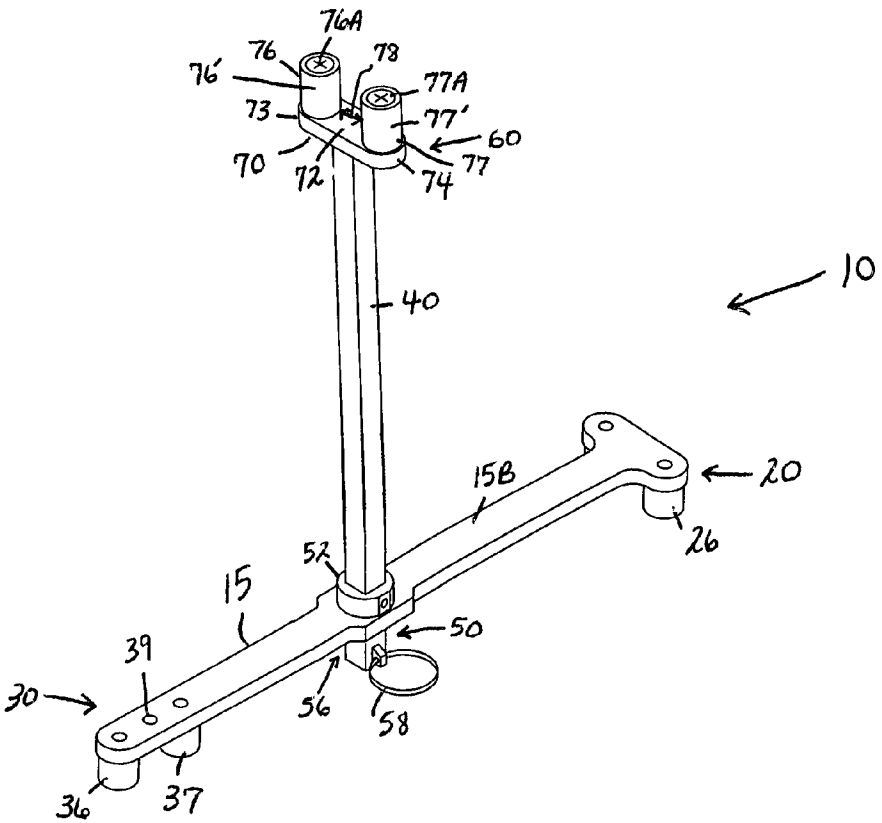
FIG. 2 is a perspective view of the bending tool of FIG. 1 with the vertical member.
Figure 3:
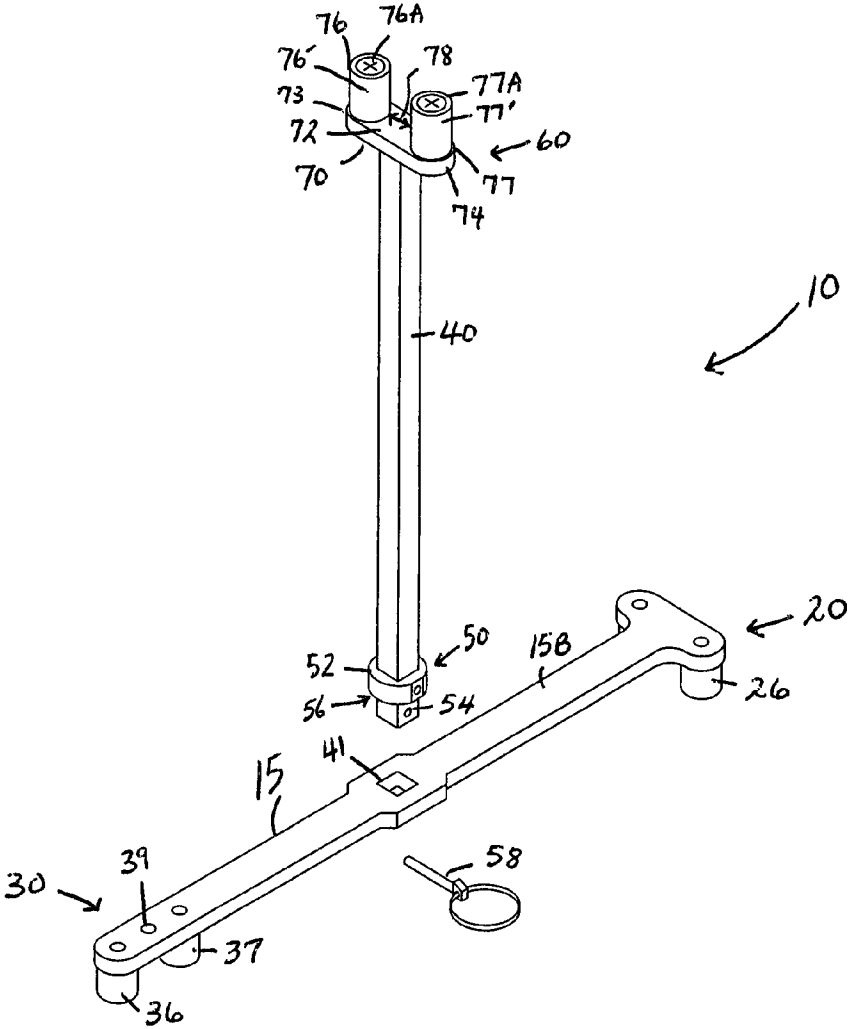
FIG. 3 is an exploded perspective view of the bending tool illustrated in FIG. 2.

Referring to FIGS. 2 and 3, there is illustrated the bending tool 10 described in FIG. 1, with the addition of a vertical member 40. More particularly, the main body 15 defines a first side 15A (shown in FIG. 1) and a second side 15B (shown in FIGS. 2 and 3), and is adapted to include an aperture 41 disposed in the approximate midway of the length of the body 15. The aperture 41 is sized and shaped to frictionally receive the vertical member 40.

As illustrated, the vertical member 40 includes a first end 50 and a second end 60. A top member 70 is affixed to the second end 60 and is in perpendicular relationship with the length of the vertical member 40, the vertical member 40 and top member 70 forming a T-shaped configuration. The top member 70 further includes a surface 72 that defines opposite ends 73, 74 of the top member 70.

The opposite ends 73, 74 each having metal dowles 76, 77 respectively, fixably attached with couplings 76A, 77A, to the top member 70. As illustrated the metal dowles 76, 77 are spaced apart and define a spacing 78 therebetween. As will be understood, in application, the spacing 78 is sized for releasably receiving a cable wire (not shown) such as the 500 MCM cable, between the metal dowles 76, 77. The metal dowles 76, 77 having a generally cylindrical configuration and further including an outer surface 76' and 77'.

As is known in the art, many of the building cables or wires available include a nylon jacket that is abrasion-resistant having a slippery surface. The inventor has determined it critical, when working with cable having a slick surface, for the outer surfaces 76' and 77' of the dowles to define an outer knurled periphery in order to create a traction between the slick nylon jacket of the cable and the metal dowles 76, 77. Further, should the knurled outer surface 76', 77' begin to wear, the couplings 76A, 77A can be loosened such that the dowles 76, 77 can be rotated on the top member 70.

As will be further described, the vertical member 40 is received through the aperture 41 such that the vertical member 40 is in perpendicular relationship with the main body 15. A stop 52 and aligned first and second apertures 54, 55 (not shown) respectively are disposed in a lower portion 56 of the first end 50. In application, the first end 50 of the vertical member 40 is received through the aperture 41 until the stop 52 is in contact with the second side 15B of the main body 15. As understood, the stop 52 serves as a stop for inserting the first end 50 as described. A pin member 58 extends through the first and second apertures 54, 55. More particularly, the pin member 58 secures the vertical member 40 to the main body 15 such that the main body 15 is sandwiched between the stop 52 pin member 58. The pin member 58 extends through the aligned apertures 54, 55, and is dimensioned such that it fits snugly by sliding through the passage way defined by the aligned apertures 54, 55, and is of a length such that it extends through the apertures 54, 55.

Although the description above contains many specificities, these should not be construed as limiting the scope of the invention but as merely providing illustrations of some of the presently preferred embodiments of this invention. Thus the scope of the invention should be determined by the appended claims in the formal application and their legal equivalents, rather than by the examples given.

I claim:

1. A bending tool for bending and shaping general purpose building wire and cable, said bending tool comprising:

a straight body portion having a length, a first end and a second end opposite said first end, wherein said first end and said body portion form a T-shaped configuration, and wherein said first end defines first and second opposite ends, said first opposite end includes a first dowel and said second opposite end includes a second dowel, and wherein said first and second dowels are spaced apart along a first axis and defines a first spacing therebetween, said first spacing sized for releasably receiving cable wire, and wherein said first axis is perpendicular to said length, wherein said second end includes a third and fourth dowel that are spaced apart along a second axis and define a second spacing therebetween, and wherein said axis is perpendicular to said second axis.

2. The bending tool as recited in claim 1, wherein said first and second dowels each have an outer knurled surface.

3. The bending tool as recited in claim 1, wherein said third and fourth dowels each have an outer knurled surface.

4. The bending tool as recited in claim 1, further including a vertical member, and wherein said body portion further includes a central aperture sized and shaped to releasably secure a first end of said vertical member, and wherein said vertical member includes a vertical body, and a second end opposite said vertical member's first end and wherein said vertical member's second end and vertical body form a T-shaped configuration, and wherein said second end of said vertical member defines first and second distal ends, said first distal end includes a fifth dowel and said second distal end includes a sixth dowel, and wherein said fifth and sixth dowels are spaced apart and define a third spacing therebetween, said third spacing sized for releasably receiving cable wire.

5. The bending tool as recited in claim 4, wherein said first end of said vertical member includes a stop and aligned first and second apertures such that the body portion is disposed between said stop and aligned first and second apertures and inserting a pin member through said aligned apertures secures the vertical member to said body portion.

6. The bending tool as recited in claim 5, wherein said fifth and sixth dowels each have an outer knurled surface.

7. The bending tool as recited in claim 5, wherein said central aperture is disposed in the approximate midway of the length of said body portion.

8. A bending tool comprising:

a main body having a length, a first end and a second end opposite said first end, wherein said first end defines first and second opposite ends, said first opposite end includes a first dowel and said second opposite end includes a second dowel, and wherein said first and second dowels are spaced apart along a first axis and define a first spacing therebetween, wherein said second end includes a pair of dowels in parallel to said length, and wherein said pair of dowels are spaced apart along a second axis and define a second spacing therebetween, and wherein said first axis is perpendicular to said second axis.

9. The bending tool as recited in claim 8, wherein said main body having an elongated configuration.

10. The bending tool as recited in claim 9, further including a vertical member, and wherein said main body further includes a central aperture sized and shaped to receive a first end of said vertical member, and wherein said vertical member includes a distal end opposite said first end, said distal end is in perpendicular relation to a length of said vertical member, and wherein said distal end defines upper first and second opposite ends, each of said upper first and second opposite ends including an upper dowel, and said upper dowels are spaced apart and define a third spacing therebetween.

11. The bending tool as recited in claim 10, wherein said first end of said vertical member includes a stop and aligned first and second apertures such that the main body is disposed between said stop and aligned first and second apertures and inserting a pin member through said aligned apertures secures the vertical member to said main body.

12. The bending tool as recited in claim 11, wherein said main body further including a third aperture disposed between said pair of dowels.

* * * * *